United States Patent [19]

Hagmann

[11] Patent Number: 4,796,501

[45] Date of Patent: Jan. 10, 1989

[54] APPARATUS FOR PUNCHING OUT A PART FROM A WORKPIECE

[76] Inventor: Peter Hagmann, Bohnackerweg 4, CH-2545 Selzach, Switzerland

[21] Appl. No.: 74,529

[22] Filed: Jul. 16, 1987

[30] Foreign Application Priority Data

Jul. 19, 1986 [DE] Fed. Rep. of Germany ..... 3624490

[51] Int. Cl.[4] ..... B26F 1/40

[52] U.S. Cl. ..... 83/535; 83/539; 83/139; 83/653; 83/575

[58] Field of Search ..... 83/533, 1, 537, 539–541, 83/653, 139, 652, 654, 655

[56] References Cited

U.S. PATENT DOCUMENTS

| | | | |
|---|---|---|---|
| 921,503 | 5/1909 | Bates | 83/535 X |
| 1,387,828 | 8/1921 | Beebe | 83/541 |
| 1,650,314 | 11/1927 | Ackermann | 83/139 X |
| 2,116,364 | 5/1938 | Reed | 83/652 |
| 2,467,546 | 4/1949 | Anderson | 83/541 |
| 3,171,318 | 3/1965 | Muhlbach | 83/541 X |
| 3,178,976 | 4/1965 | Kraut | 83/541 X |
| 3,269,234 | 8/1966 | Talas | 83/540 X |
| 3,289,515 | 12/1966 | Chiesa | 83/533 |

FOREIGN PATENT DOCUMENTS

| | | | |
|---|---|---|---|
| 796816 | 1/1936 | France | 83/653 |

*Primary Examiner*—Frank T. Yost
*Assistant Examiner*—Rinaldi Rada
*Attorney, Agent, or Firm*—Bachman & LaPointe

[57] ABSTRACT

In an apparatus for punching out a part from a workpiece or blank, particularly for punching out a segment from a photograph, for the engagement of the workpiece a punching table is arranged under a punching plate which can be rotated away and lowered in direction x, a punching pattern being placed on the workpiece.

9 Claims, 3 Drawing Sheets

APPARATUS FOR PUNCHING OUT A PART FROM A WORKPIECE

BACKGROUND OF THE INVENTION

The present invention relates to an apparatus for punching out a part from a workpiece or blank, particularly for punching out a photograph segment from a photograph and/or further processing of said workpiece, as well as for a method for the same.

For example, nowadays passport photographs must have a size precisely stipulated by the corresponding state authorities. However, photographic laboratories produce passport pictures which do not precisely correspond to the predetermined sizes. The passport official must then normally cut the submitted photograph to a given size, which is time-consuming and imprecise.

In other working fields there is often also a need to punch or stamp a given segment from a predetermined larger blank, without the segment being predetermined. In such cases mainly manual work using scissors is involved. There is no automatic or even semiautomatic punching tool, because hitherto the known apparatuses have required a prior centering of the workpiece under the actual punching tool.

SUMMARY OF THE INVENTION

The problem of the invention is to develop a simple apparatus, in which the dependence of the workpiece to be processed is independent of the punching tool position. In particular it must be possible to choose a random segment from the workpiece, without having to centre the latter.

According to the invention this problem is solved in that for applying a workpiece a punching table is arranged under a punching plate which can be rotated away and lowered, a punching pattern or similar processing tool being mounted on the workpiece. The concept of the punching pattern is only intended as an example of an activity. The inventive apparatus also makes it possible to apply impressions to a photograph or to destroy photographs by perforation. In each case a tool is used which is appropriate for this activity.

Thus, in this apparatus, punching table, punching plate and punching pattern are made independent of one another, so that in the region defined by the punching table or plate, the punching template can be moved on a workpiece until the desired segment is found. Within this area in each case the punching action of the punching plate is obtained.

Such an apparatus can be used for producing passport photographs. However, it is also possible to use this apparatus for dealing with various other workpieces and blanks, such as e.g. leather, textiles, plastics, e.g. plastic animals, etc.

Lowering of the punching plate preferably takes place by means of an electromagnetic drive, such as is known from U.S. Pat. No. 4,583,350, dated Apr. 22, 1986, which patent is incorporated herein by reference. This electromagnetic drive has significant advantages, which are also described in said U.S. patent.

If, for example, the punching plate is fixed on the lowerable outer casing of the drive, then the inner core of the magnetic drive is connected to a bottom plate. This means that the outer casing, a core in the outer casing or the actual punching plate is drawn towards the fixed magnetic core and is lowered therewith. In preferred manner, the punching plate or parts of the drive are guided along a pivot axis, about which the punching plate can be rotated out of its position of use over the punching table. This pivot axis can e.g. be formed by a guide bolt arranged between a top plate and a bottom plate and along which slides a sleeve, which is connected to the punching plate.

The reinforcement of this apparatus structure formed by the bottom plate and the top plate is provided by a rear wall interconnecting the two parts and correspondingly arranged reinforcing legs.

The punching plate is rotated or turned away by means of a handle, whereby said plate can be turned both to the left and to the right and consequently the apparatus is equally well suited to left-handed and right-handed persons. For reasons of simplicity, the handle can incorporate the button for operating the electromagnetic drive, whose control unit is e.g. fixed to the rear wall of the apparatus structure.

For raising the punching plate, e.g. following a punching process into its initial position a spring is provided, which also presses a ball against the underside of the punching plate. In certain predetermined positions, said ball must run into locking trays on the underside of the punching plate.

According to the invention, there are also innovations on the punching table. Firstly it is preferably vertically adjustable, which is brought about by means of a threaded bolt, which can be inserted into the bottom plate, as required. In addition, the punching table comprises a punching disk and a lower worktable, between which there is a layer of an elastic material, e.g. rubber or foam. This elastic layer is e.g. bonded in, a pin from the lower worktable engaging in a centring bore in the punching disk. However, said pin has an adequate distance from the edges of the centering bore, so that the punching table can be tilted by a certain amount with respect to the lower worktable and in which the elastic intermediate layer is compressed. This makes it possible to a certain extent to keep the punching disk constantly plane-parallel to the underside of the punching plate. If, for example, the workpiece has a different thickness, as a result of a tiltable punching disk, this difference can also be compensated to a certain extent.

The punching pattern used for the present invention comprises a top layer and an elastic layer. A viewing window is cut from the two layers and in it is inserted a knife or cutter frame. In the normal position, the cutter frame disappears in the viewing window, i.e. the plane of the elastic layer projects over the frame. However, if during the punching process the elastic layer is compressed, the metal frame moves out and can punch out the desired part. On raising the punching plate, the elastic layer tension is relieved and the remaining blank is stripped from the metal frame.

A corresponding method is characterized in that the workpiece is placed on a punching table, a punching pattern is placed on the segment to be punched out and then a punching plate is lowered onto the pattern with the aid of an electromagnetic drive. Prior to the engaging of the workpiece, it is important to rotate away the punching plate and following engagement it is again guided over the workpiece or punching pattern. This turning away of the punching plate makes it possible to place the pattern on the desired segment without any difficulty, because it is possible to see the same through the viewing window. Slipping rarely occurs as a result of the elastic layer.

BRIEF DESCRIPTION OF THE DRAWINGS

The invention is described in greater detail hereinafter relative to a non-limitative embodiment and the attached drawings, wherein show.

DETAILED DESCRIPTION OF THE INVENTION

Figure 1:
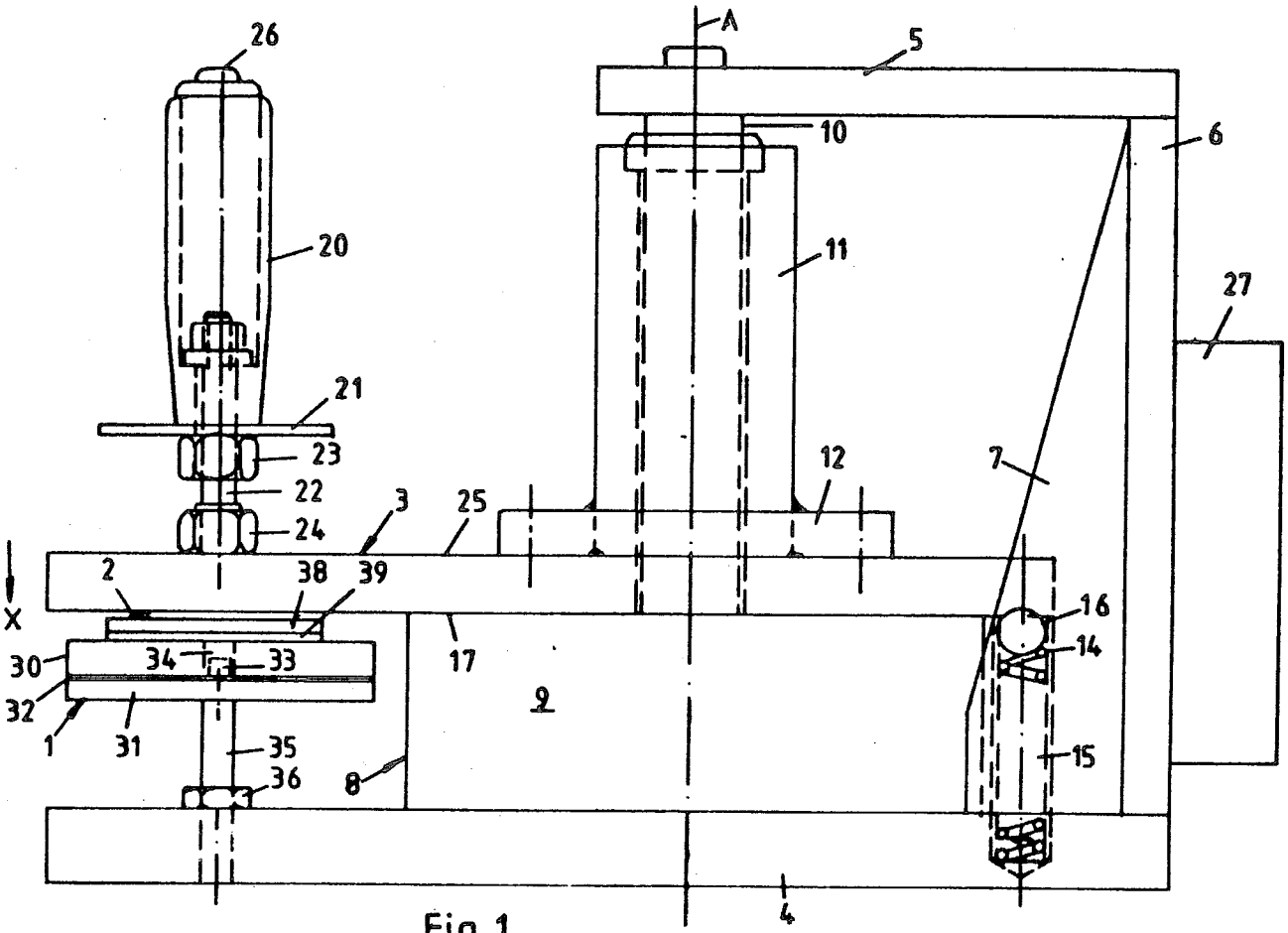
FIG. 1 A side view of an inventive apparatus for punching out parts.

An apparatus for punching out e.g. photographic segments according to FIG. 1 comprises a punching table 1, on which is placed the not shown photograph. The desired photographic segment can be sought by means of a punching pattern 2. By lowering punching plate 3 in direction x a pressure is exerted on punching pattern 2 and a photograph is punched out.

Punching plate 3 has a rotation axis A, which passes through a bottom plate 4 and a top plate 5, which are interconnected by means of a rear wall 6, on which are also fixed the reinforcing legs 7.

Figure 2:
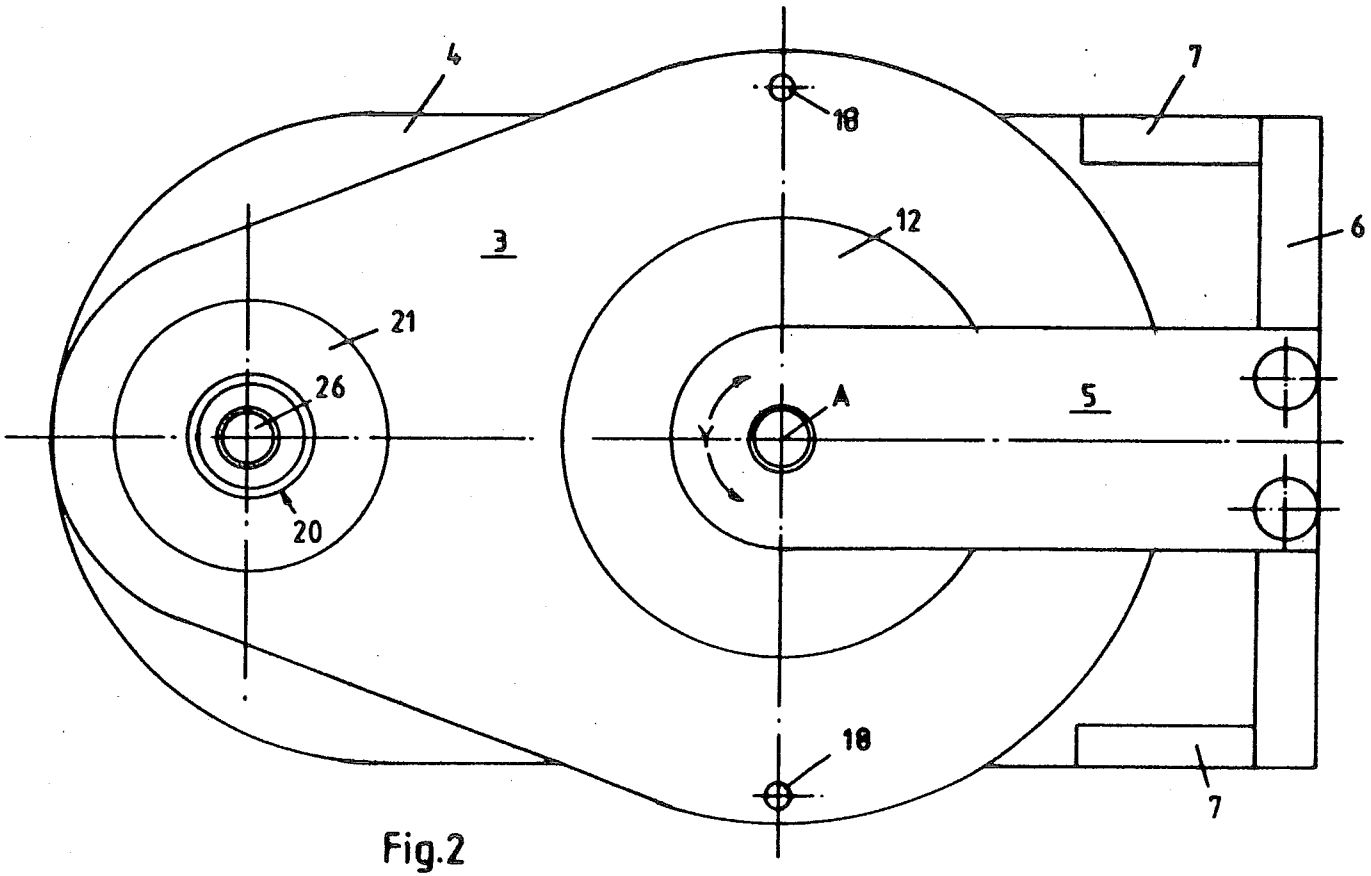
FIG. 2 A plan view of the inventive apparatus according to FIG. 1.

An electromagnetic drive 8, e.g. as described in U.S. Pat. No. 4,583,350, rests on bottom plate 5. Punching plate 3 is connected to a cylinder sleeve 9 of electromagnetic drive 8 movable in direction x. This cylinder sleeve 9 can be rotated about the common axis A in direction y (cf. FIG. 2) with the punching plate 3.

For guiding punching plate 3 in direction x along rotation axis A is provided a guide bolt 10 connected to top plate 5 and which is surrounded by a casing 11 placed over a top disk 12 of punching plate 3.

The return of punching plate 3 counter to the direction x is brought about by a return spring 14, which rests in a small tube 15 and is supported by means of a ball 16 against the underside 17 of punching plate 3. On said underside are located locking trays 18 indicated in FIG. 2, which makes it possible to fix given rotation positions of punching plate 3.

For the rotation of punching plate 3 in direction y is provided a handle 20, which has a disk 21 and is fixed by means of connecting bolts 22 and various nuts 23, 24 to the top 25 of punching plate 3. At the front a pushbutton 26 is provided in handle 20 and by means thereof can be operated a control unit 27 for putting the electromagnetic drive into operation.

Punching table 1 comprises the actual punching disk 30 serving as the mounting support for the punching pattern 2. This punching disk 30 rest on a lower worktable 31, an elastic intermediate layer 32 being provided between punching disk 30 and lower worktable 31. The function of the elastic intermediate layer 32 is to compensate tilting between punching plate 3 and punching pattern or punching disk 30. Therefore a pin 33 projects into a centring bore 34 in punching disk 30, said pin 33 having a certain clearance with respect to centring bore 34. This allows tilting or twisting of punching disk 30.

In addition, punching table 1 is connected by means of a threaded bolt 35 to bottom plate 4, its height being variable and fixable by means of a nut 36.

Figure 3:
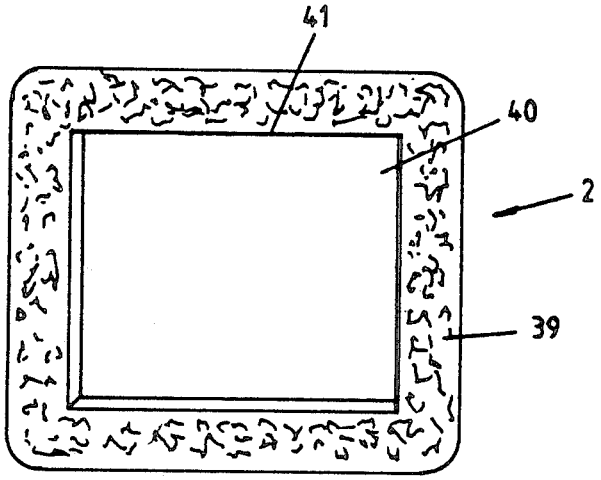
FIG. 3 A view from below of an inventive punching pattern.

The punching pattern 2 comprises a top layer 38, below which is placed an elastic layer 39. Out of the top layer 38 and elastic layer 39 is cut a viewing window (cf. FIG. 3), whose marginal edges are occupied by a knife or cutter frame 41. Outside the actual cutting process, said cutter frame 41 disappears below the plane of elastic layer 39. Only on starting the punching process, is the elastic layer compressed by means of punching plate 3 or top layer 38 and the cutter frame can pass out of the plane of elastic layer 39 and punch out a segment, e.g. of a photograph.

The apparatus functions as follows. For placing a photograph on punching table 1, the punching plate 3 is swung away in rotation direction y by means of handle 20. It is unimportant whether the apparatus is being used by a left-handed or right-handed person.

On pivoting away, ball 16 slides out of its corresponding locking tray and following a certain rotation in direction y, runs into a lateral locking tray 18. The photograph can now be placed on the punching disk 30. This is followed by the centring of the segment to be punched out by means of punching pattern 2. Punching pattern 2 can be readily moved backwards and forwards on the photograph, because the cutter frame 41 has disappeared within the elastic layer 39 and consequently the surface of the photograph cannot become scratched. This elastic layer, e.g. of rubber, also ensures that the punching pattern 2 has a certain adhesion on the photograph, so that there can be no accidental displacement of the punching pattern 2.

Punching plate 3 is now returned to its initial position, where it is located above the punching pattern 2. There is no need to centre punching plate 3 with respect to punching pattern 2.

By pressure on the pushbutton 26 the electromagnetic drive is energized by control unit 27 and punching plate 3 is moved in direction x. Punching plate 3 is guided on guide bolt 10 by means of casing 11, so that there is a substantially horizontal lowering of punching plate 3. This substantially horizontal lowering of punching plate 3 is also favourably influenced by the inventive construction of the support frame constituted by bottom plate 4, rear wall 6 and top plate 5 with reinforcing legs 7.

On lowering punching plate 3 in direction x, the underside 17 of punching plate 3 presses on the punching pattern 2, which leads to a compression of elastic layer 39 of punching pattern 2. Thus, the cutter frame 41 passes out of the elastic layer 39 and punches a specific portion from the underlying photograph. If, contrary to expectation, the punching plate 3 has a certain tilt with respect to the punching pattern 2 or punching table 1, then this is compensated with respect to the photograph by elastic layer 39, as well as the elastic intermediate layer 32.

As soon as the punching process is ended, the magnetic force is removed and punching plate 3 is returned to its starting position by means of return spring 14. Punching plate 3 can then be rotated away and pattern 2 with the segment can be raised from the remainder of the photograph. This has revealed a further advantage of elastic layer 39. On removing tension it strips the remaining photograph from the cutter frame 41, whilst the segment remains in the viewing window 40 and merely has to be poked through with the finger.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A punching apparatus for punching out a portion of a workpiece comprising a punching table, a punching plate located above said punching table, a punching pattern for punching out a portion of the workpiece, means for driving said punching plate from a rest position toward a work position when said punch plate is in a first position whereby said punch pattern punches out a portion of the workpiece and means for rotating said punching plate around a pivot axis for rotation between said first position and a second position wherein said workpiece can be located on said punching table and biasing means for returning said punch plate from said work position to said rest position wherein said biasing means presses a detent against the underside of the punching plate and said detent runs into locking trays when said punching plate is in the first position and the second position.

2. An apparatus according to claim 1, wherein said means for driving includes an electromagnetic drive.

3. An apparatus according to claim 1, wherein the punching plate, is guided by a guide along the pivot axis when driven by said means for driving.

4. An apparatus according to claim 3, wherein the guide comprises a bolt arranged in the pivot axis and which is surrounded by a casing connected to the punching plate.

5. An apparatus according to claim 4, wherein the pivot axis is fixed between a bottom plate and a top plate interconnected by means of a rear wall and whose position is reinforced by reinforcing legs.

6. An apparatus according to claim 5, wherein the punching table is vertically adjustably connected to the bottom plate by means of a threaded bolt.

7. An apparatus according to claim 6, wherein the punching table comprises a punching disk and a lower worktable with interposed elastic intermediate layer.

8. An apparatus according to claim 7, wherein a pin projects from the lower worktable into a centering bore in the punching disk.

9. An apparatus according to claim 1, wherein means for rotating the punching plate, comprises a handle which is simultaneously provided with a pushbutton for operating a control unit for said means for driving.

* * * * *